US008375915B1

(12) United States Patent
Now

(10) Patent No.: US 8,375,915 B1
(45) Date of Patent: Feb. 19, 2013

(54) GAS DIRECTING SYSTEM AND METHOD

(76) Inventor: Leo Now, South San Francisco, CA (US)

( * ) Notice: Subject to any disclaimer, the term of this patent is extended or adjusted under 35 U.S.C. 154(b) by 935 days.

(21) Appl. No.: 12/392,937

(22) Filed: Feb. 25, 2009

(51) Int. Cl.
*F02M 35/10* (2006.01)

(52) U.S. Cl. ..... 123/184.21; 123/184.38

(58) Field of Classification Search ..... 123/184.21, 123/184.38–184.45
See application file for complete search history.

(56) References Cited

U.S. PATENT DOCUMENTS 1,439,506 A * 12/1922 Durr ..... 181/263
3,605,404 A * 9/1971 Bjork ..... 60/308
3,868,936 A 3/1975 Rivere
4,050,539 A 9/1977 Kashiwara et al.
4,303,386 A * 12/1981 Voorheis et al. ..... 431/177
4,556,032 A 12/1985 Miller
5,048,327 A 9/1991 Atwood
5,263,426 A * 11/1993 Morita et al. ..... 110/265
5,836,738 A * 11/1998 Finney ..... 415/60
5,947,072 A * 9/1999 Loy et al. ..... 123/184.56
6,148,782 A 11/2000 Fuesser
7,263,961 B2 9/2007 Now

* cited by examiner

*Primary Examiner* — Noah Kamen
(74) *Attorney, Agent, or Firm* — DLA Piper LLP (US)

(57) ABSTRACT

An gas directing/exhaust system and method are provided that has different embodiments. In some embodiments, the gas directing mechanism has a first pathway and a second pathway. In other embodiments, the gas directing mechanism has a second pathway and one or more first pathways located inside of the second pathway. In other embodiments, the gas directing mechanism has the first and second pathways and a third pathway inside of the second pathway.

10 Claims, 16 Drawing Sheets

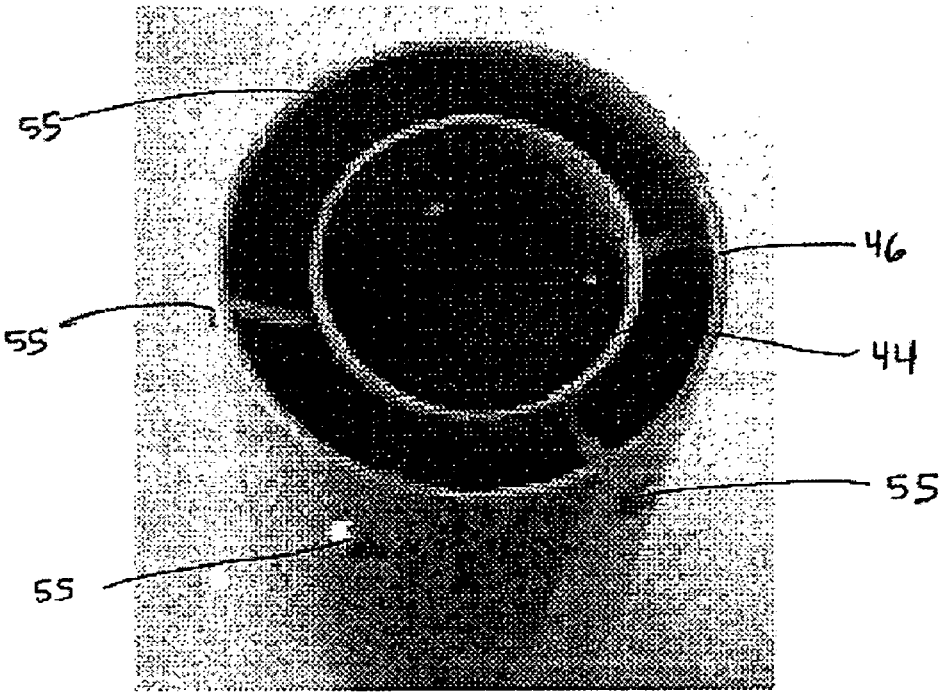
FIGURE 4C1
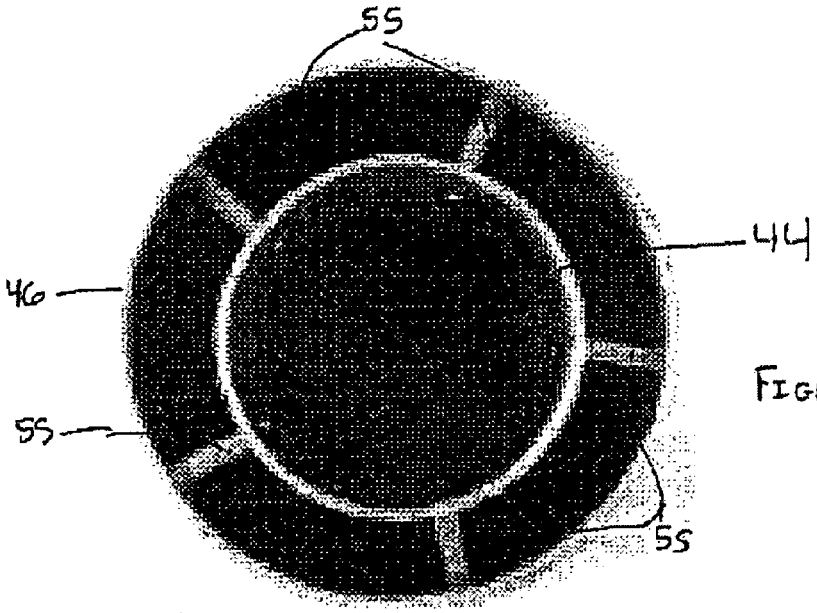
FIGURE 4C2

DYNORUN.015 70.4 °F 29.92-0.40 in.Hg. 110 ft. CF=0.98 RPM/MPH=80
Max POWER = 102.7 Max TORQUE = 91.4
run1

DYNORUN.049 82.6 °F 29.92-0.62 in.Hg. 110 ft. CF=1.00 RPM/MPH=80
Max POWER = 107.1 Max TORQUE = 96.1

DYNORUN.051 82.9 °F 29.92-0.61 in.Hg. 110 ft. CF=1.00 RPM/MPH=80
Max POWER = 109.1 Max TORQUE = 97.2

DnR Performance

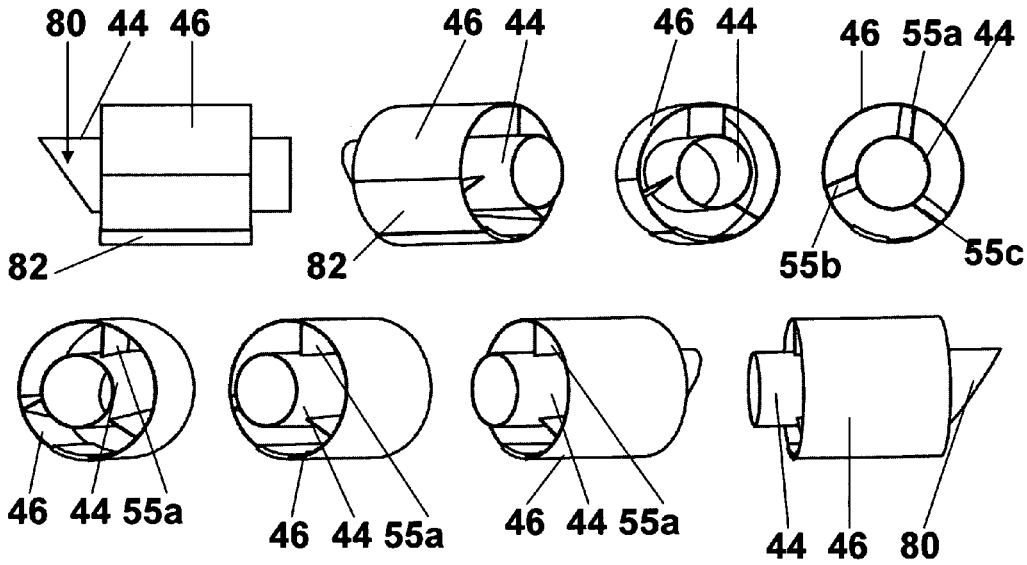
FIGURES 11A-H

GAS DIRECTING SYSTEM AND METHOD

FIELD

The disclosure relates generally to a system and method for directing a gas flow and in particular to a system and method for directing gases (intake gas or exhaust gases) in an internal combustion engine.

BACKGROUND

It is well known that internal combustion engines require a flow of air to operate. In particular, the air and fuel are mixed together and then ignited to generate energy which translates into power, for example, to move a piston up. An internal combustion engine may be used for a variety of different purposes, including powering a vehicle, generating energy, such as a gasoline powered portable generator, and many other uses. The temperature and amount of air flowing into the internal combustion engine affects the performance of the engine as is well known.

In order to increase the performance of an internal combustion engine, the temperature and amount of air being provided to the internal combustion engine may be adjusted. For example, an automobile may be turbo charged in which the incoming air is compressed and then fed into the internal combustion engine. The turbo charging of an internal combustion engine, however, is expensive and difficult to install for anyone other than an experienced mechanic. Another less expensive option is to attempt to lower the temperature of the incoming air flow while at the same time increasing the air flow. This can be accomplished using after-market add on components which replace the original gas directing system. One example of a known system is made by AEM Power, Inc. (http://www.aempower.com). According to AEM Power, this system creates multiple frequency sound waves to help charge the cylinders with air in the upper engine RPM region. According to AEM Power, a shorter secondary pipe generates high frequency sound waves with higher engine RPMs and the smaller, longer primary pipe generates lower frequency sound waves at lower engine RPMs. This system does result in an increase in engine horsepower and torque. The same system described above may also be used to engine exhaust gases. However, the horsepower and torque gain from the AEM V2 Intake System can still be further increased. Thus, it is desirable to provide an gas directing system and method that produces more horsepower and torque, and it is to this end that the present invention is directed.

BRIEF DESCRIPTION OF THE DRAWINGS

FIGS. 4A-4J illustrate the manufacturing steps of the preferred embodiment of the gas directing mechanism;

FIGS. 7A-7J illustrate other embodiments of the gas directing mechanism;

FIGS. 11A-11H illustrate an enhanced gas directing mechanism.

DETAILED DESCRIPTION OF ONE OR MORE EMBODIMENTS

The system and method are particularly applicable to an gas directing system for an internal combustion engine, such as a vehicle engine, and it is in this context that the invention will be described. It will be appreciated, however, that the gas directing system and method has greater utility since it may be used to direct various different gases including air and may be used with various types of internal combustion engines that are used for various different purposes. The gas directing system may also be used with any system in which it is desirable to provide increased gas flow.

Figure 1A:
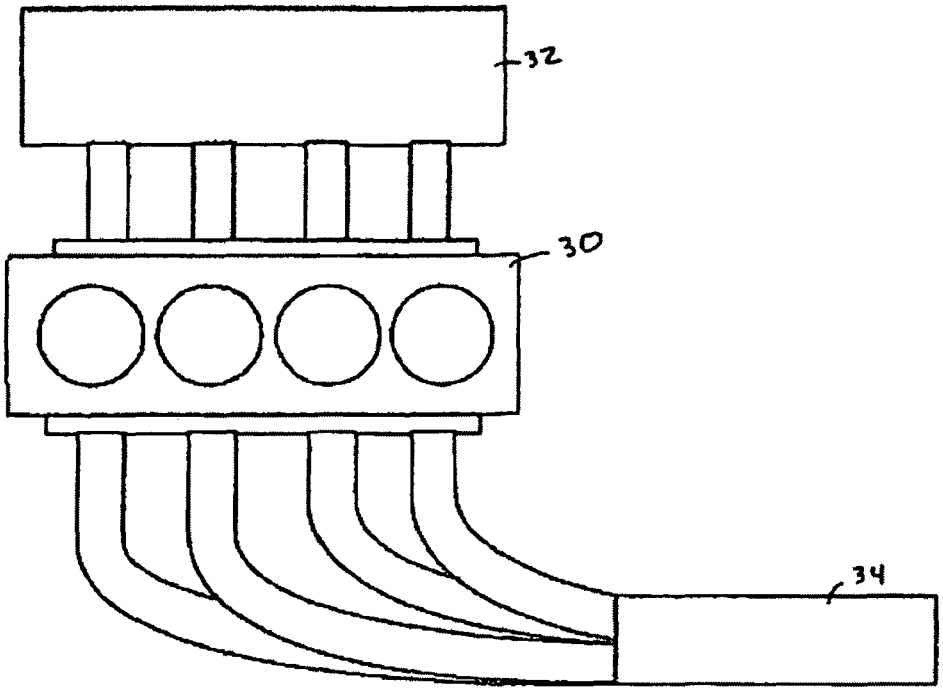
FIGURE 1A (Prior Art)
FIGS. 1A and 1B are diagrams illustrating a typical exhaust manifold and an exhaust manifold, respectively.
Figure 1B:
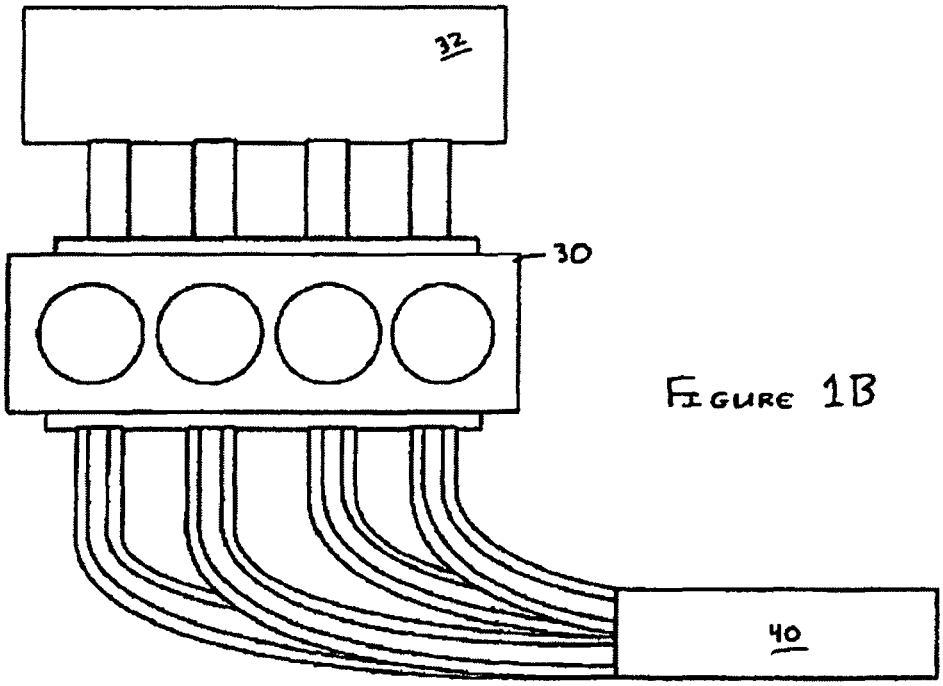

FIGS. 1A and 1B are diagrams illustrating a typical exhaust manifold for an internal combustion engine and an exhaust manifold, respectively. In particular, FIG. 1 illustrates a typical internal combustion engine 30 with a typical gas directing manifold 32 and a typical exhaust manifold 34 as are well known. The gas directing manifold 32 provides air into the internal combustion engine so that it can be mixed with fuel and ignited while the exhaust manifold 34 generates a slight back pressure and exhausts the exhaust gases out of the internal combustion engine as is well known. The gas directing system, as described below, may replace the typical gas directing system 32 or the typical exhaust system 34 to provide increased horsepower and torque for the internal combustion engine. Thus, as shown in FIG. 1B, the typical exhaust manifold 34 (shown in FIG. 1A) may be replaced by a gas directing system 40. Thus, an embodiment of the gas directing/exhaust system is when it is attached to the exhaust system or air intake of an internal combustion engine is shown.

Figure 2:
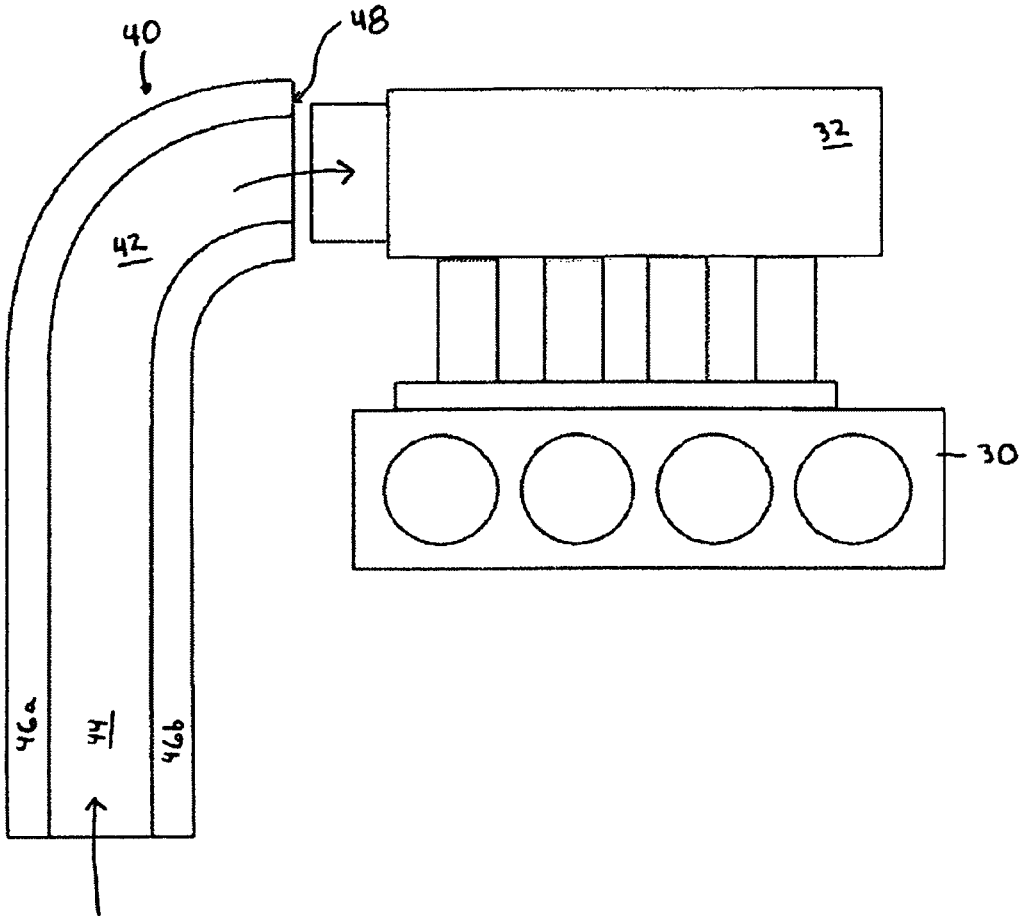
FIG. 2 is a diagram illustrating an gas directing system.

FIG. 2 is a diagram illustrating an gas directing system 40 which fits onto a typical gas directing manifold 32 so that the gas directing system is attached to the gas directing system of the internal combustion engine 30 in this embodiment. The gas directing system 40 comprises a gas directing mechanism 42 which directs air (as shown by the arrows) from an external source to the gas directing manifold 32. In accordance with the invention, the gas directing system 40 increases the velocity of the air entering the internal combustion engine and increases the airflow by increasing the airspeed of a gas, such as air, into the air intake manifold 32. The gas directing system 40 comprises a dual pathway design (wherein different embodiments of the dual pathway design are described below and illustrated in FIGS. 7A-J and FIGS. 8A-8F). The dual pathway design comprises a first pathway 44 and a second pathway 46*a*, 46*b*. In a preferred embodiment, each pathway may be a tube and the first tube 44 may be concentric with and fit within the second tube 46. Thus, the smaller size (the smaller diameter of the first tube 44 in the preferred embodiment) of the first pathway 44 allows a smaller air mass to move at a higher rate of speed than the airflow in the second pathway 46*a*, 46*b*. In accordance with the invention, as the two different air masses with different velocities meet at an output end 48 of the gas directing mechanism 42, the air masses are combined and greatly increase the airspeed of the combined air mass. The result is that a greater amount of air moves into the internal combustion engine at a higher rate of speed than is possible with a typical gas directing system.

Figure 3A:
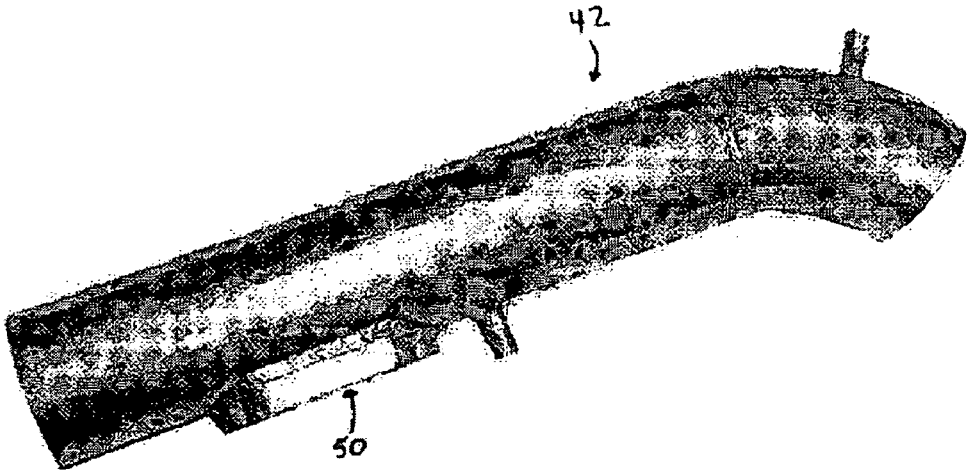
FIGS. 3A and 3B are diagrams illustrating a perspective view and an end view, respectively, of a gas directing mechanism.
Figure 3B:
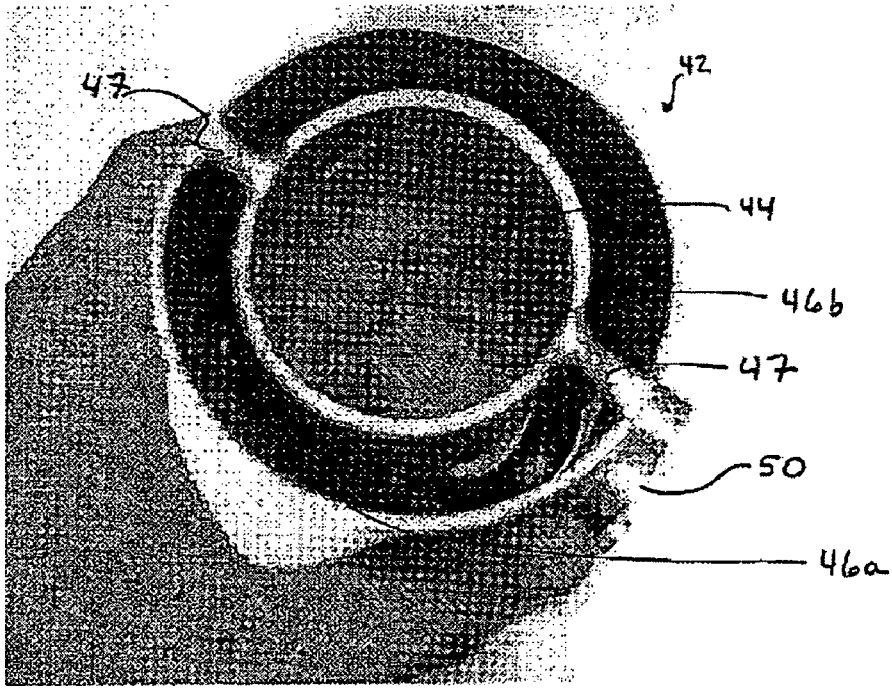
Figure 3C:
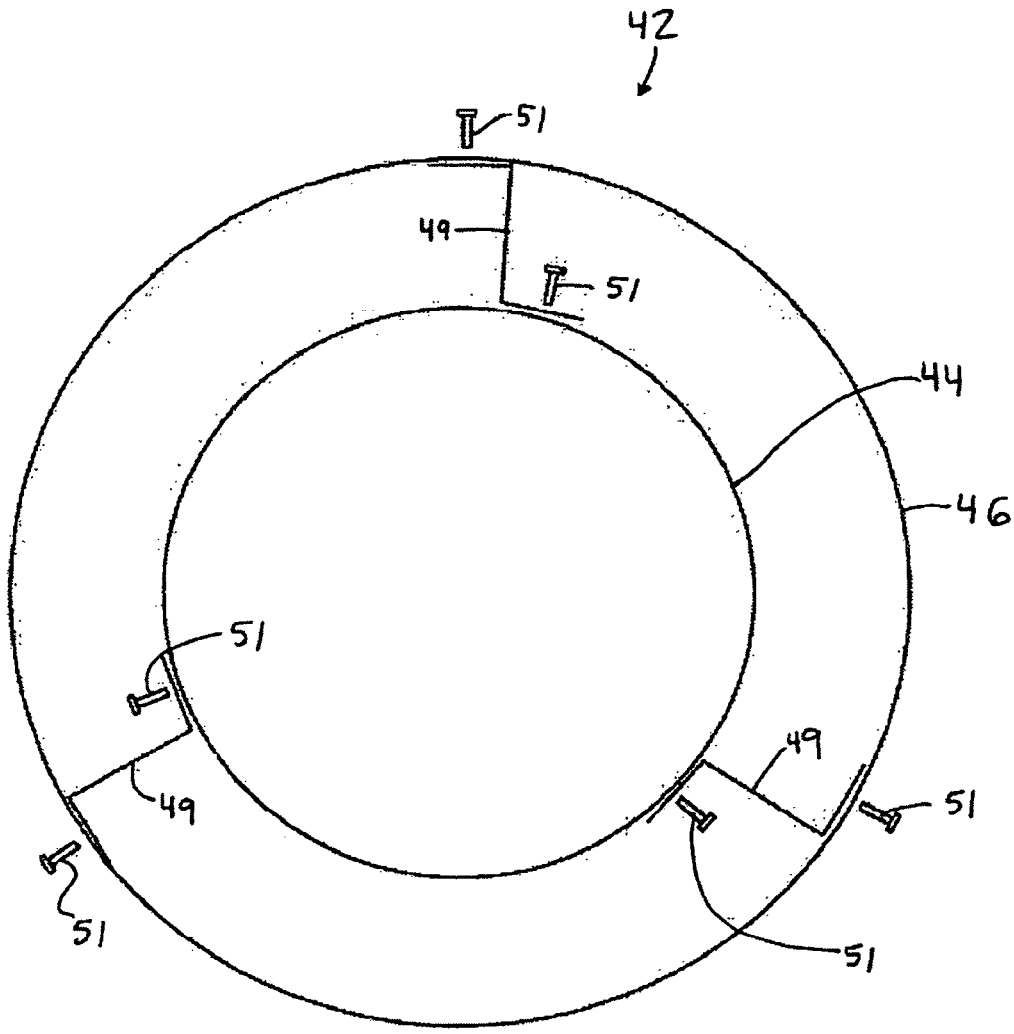
FIG. 3C illustrates a method for connecting the first pathway to the second pathway.

FIGS. 3A and 3B are diagrams illustrating a perspective view and an end view, respectively, of an gas directing mechanism 42 in accordance with the invention. As shown in FIG. 3A, the gas directing mechanism 42 may optionally include one or more sensor ports 50. The ports permit a typical air sensor to be attached to the gas directing mechanism, permit a vacuum sensor to be connected to the gas directing mechanism for idle control, and/or permit PCV ports to be connected to the gas directing mechanism for positive crank case ventilation, etc. It should be noted that the gas directing mechanism 42 shown in FIG. 3A has a particular shape (a straight tube with a slightly bent end portion) and that the invention is not limited to any particular shape as the shape will be adjusted/changed depending on the particular internal combustion engine with which it is being used. For example, each different vehicle engine may likely require a slightly differently shaped gas directing mechanism 42. FIG. 3B is an end view of the gas directing mechanism 42 with the first pathway 44 and the second pathway 46*a*, 46*b*. In the embodiment shown, the first and second pathways 44 and 46*a*, 46*b* are tubes which are concentric and welded to each other using support arms 57. A preferred embodiment of a method for attaching the first and second pathways to each other is shown in FIG. 3C and described below. In this embodiment, the first and second pathways are constructed out of aluminum. However, the invention is not limited to any particular material and may also be made from plastic or other materials that are capable of withstanding the temperatures to which the gas directing mechanism may be subjected. For example, for a gas directing mechanism for an automobile that is housed underneath the hood of the automobile, the gas directing mechanism must be able to withstand the temperatures underneath the hood of the automobile. As set forth above, this gas directing mechanism 42 may be used for both the gas directing system or exhaust system for an internal combustion engine. If it is being used for the air exhaust system, the gas directing mechanism in accordance with the invention may be required to withstand a higher air temperature and be more resistant to damage so it must be made of a different material which is within the scope of the invention.

FIG. 3C illustrates a method for connecting the first pathway 44 and the second pathway 46 to each other. As shown, the gas directing mechanism 42 may further comprise a bracket 49 which is preferably shaped so that the bracket is able to connect the first and second pathways 44, 46 to each other. In the embodiment shown in FIG. 3C, there are three brackets but the invention is not limited to any particular number of brackets. In accordance with the invention, the bracket(s) 49 are attached to each of the first pathway and second pathway. In the example shown in FIG. 3C, the bracket(s) are attached to each pathway using an attachment mechanism 51, such as a rivet. Each bracket may also be welded onto the first and second pathways. To assemble the gas direction mechanism 42, the bracket(s) 49 are attached to the first pathway 44. The first pathway 44 with the bracket(s) 49 attached are inserted into the second pathway 46. The bracket(s) 49 are then attached to the second pathway 46.

Figure 3D:
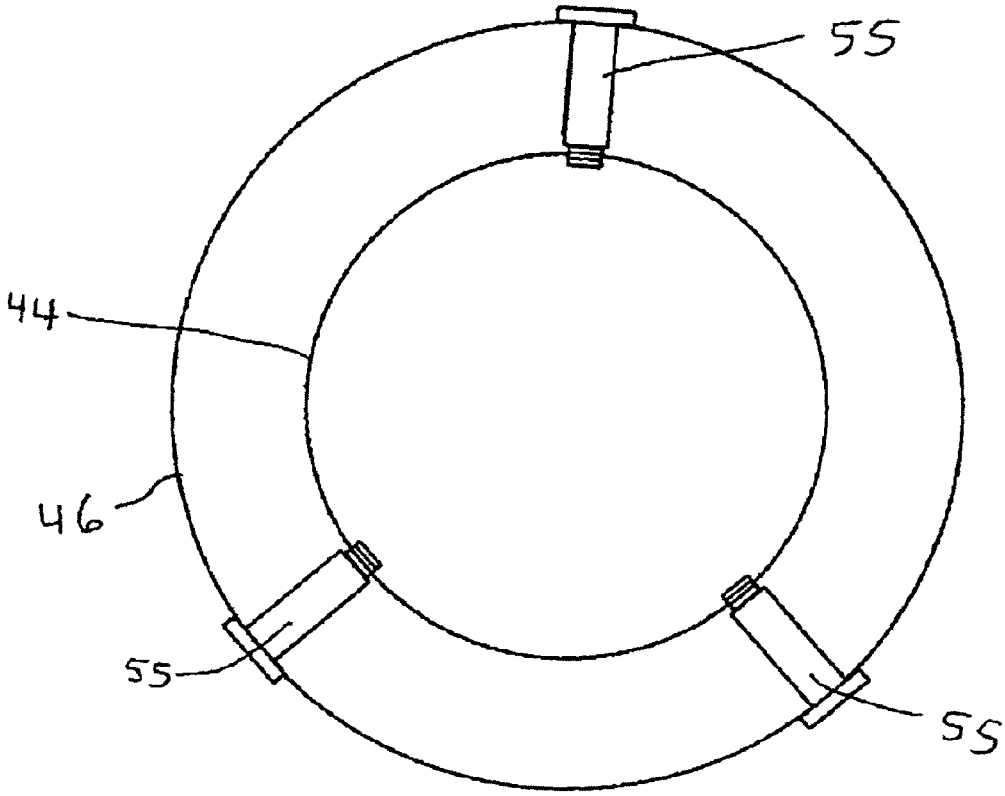
FIG. 3D illustrates a preferred method for connecting the first pathway to the second pathway.

FIG. 3D illustrates a preferred method for connecting the first pathway 44 and the second pathway 46 to each other. As shown, the gas directing mechanism 42 may further comprise an attachment device 55 that connects the first and second pathways 44, 46 to each other. In the preferred embodiment shown in FIG. 3D, there are three attachment devices but the invention is not limited to any particular number of attachment devices that may be located at different locations than shown in FIG. 3D. The attachment device 55, which may be a screw or bolt for example, is passed through a hole in the second pathway 46 and then screws into the first pathway 44. Now, more details of the gas directing mechanism 42 will be described.

Figure 4F:
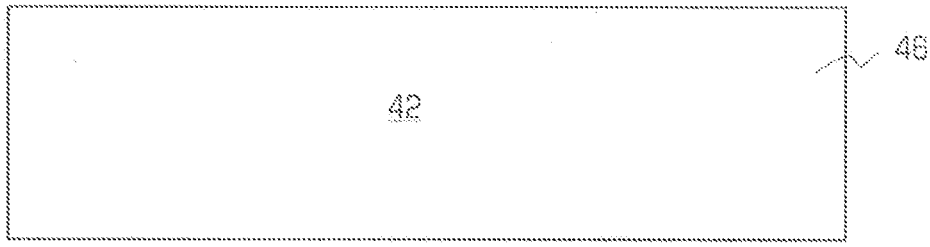
Figure 4E:
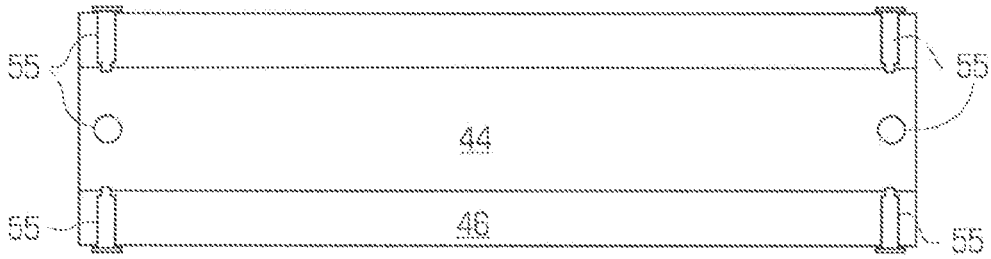
Figure 4D:
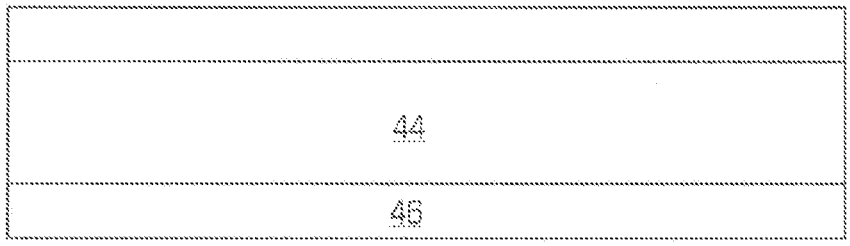
Figure 4B:
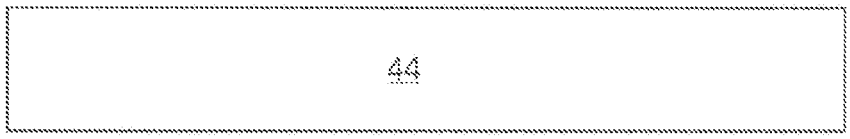
Figure 4A:
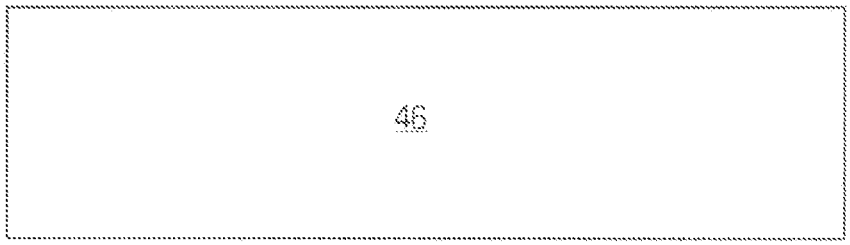

FIGS. 4A-4J illustrate the manufacturing steps of the preferred embodiment of the gas directing mechanism 42 in accordance with the invention. In this preferred embodiment, the first pathway 44 does not extend beyond the second pathway 46. In other embodiments of the invention, the first pathway 44 does extend beyond the second pathway 46 as shown in FIGS. 5A-F and 6A-D. In the preferred embodiment shown in FIGS. 4A-4J, the first pathway 44 and the second pathway 46 are shown in FIGS. 4A, 4B and 4D as a first cylindrical tube 44 and a second cylindrical tube 46. As shown in FIGS. 4C1 and 4C2, the first pathway 44 and second pathway 46 in the preferred embodiment are connected to each other by one or more attachment devices 55 that may go through a hole in the second pathway 46 and screw into the first pathway 44 to secure the pathways to each other in the positions shown in FIGS. 4C1 and 4C2 although the exact position and shape of the attachment devices 55 may be altered in accordance with the invention. The attachment devices 55 center and align the first pathway 44 with the second pathway 46 as shown in FIG. 4E. In accordance with the invention, the exact positional relationship of the first and second tubes and the attachment devices 55 may be adjusted. FIGS. 4D and 4E are cut-away views in which the internal structure of the gas directing mechanism whereas FIG. 4F is a side view of the gas directing mechanism 42 showing only the second tube 46 as the first tube 44 is inside of the second tube 46.

Figure 4G:
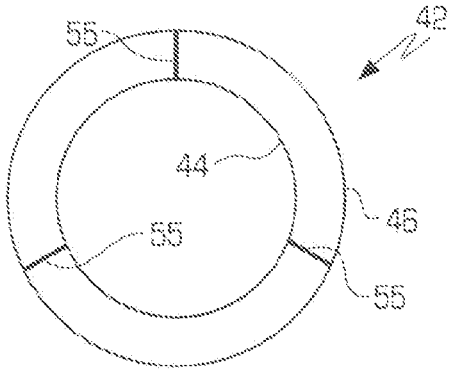
Figure 4H:
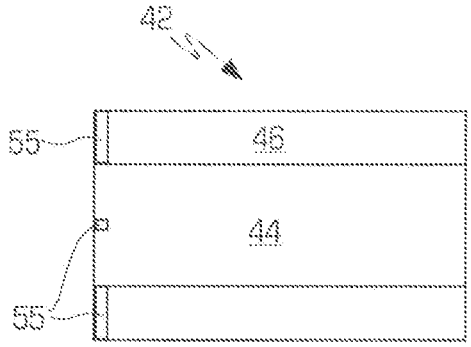
Figure 4I:
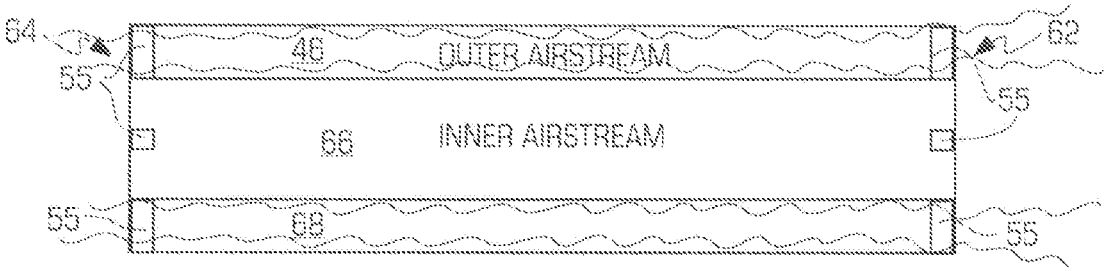
Figure 4J:
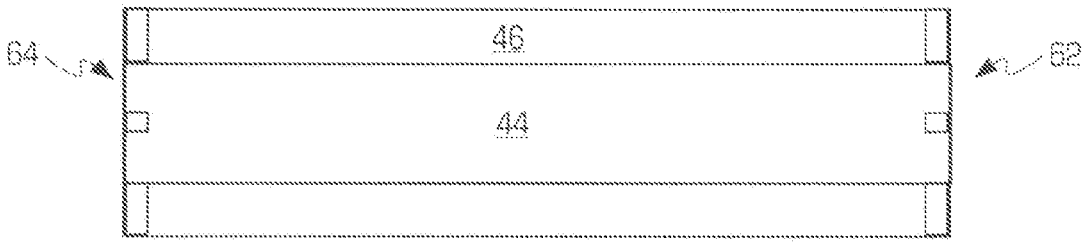

FIG. 4G illustrates an end view of the gas directing mechanism 42 with the first pathway 44 concentrically inside of the second pathway 46 wherein the positional relationship of the first and second pathways are fixed by the attachment devices 55. In this preferred embodiment, the ratio of the diameter of the first tube to the diameter of the second tube may be 2/3 (and the difference between the diameters may be 1".) In the example shown, the first tube may be 2" in diameter and the second tube may be 3" in diameter. FIG. 4H is a cut-away side view of the preferred embodiment. FIGS. 4I and 4J illustrate the air flow benefits of the gas directing mechanism 42 in accordance with the invention. In particular, the gas entering the mechanism at an intake end 62 exits the mechanism at an exit end 64 with an increased velocity. As shown in FIG. 4I, the gas directing mechanism 42 separates the incoming gas into an inner gas-stream 66 and an outer gas-stream 68 which have different velocities. In particular, based on well known airflow principles, the gasflow in the first tube 44 (which has a smaller diameter) has a greater velocity (approximately double the velocity) than the gas flowing in the second tube 46. Then, when the gas-streams of the first and second tubes meet at the exit point 64, a vacuum is created at that point which doubles the airspeed of the total gas (air, in this example) that enters the internal combustion engine. The result of this gas directing mechanism is an increase in horsepower and torque as will be described below with reference to FIG. 9. Now, other embodiments of the gas directing mechanism in accordance with the invention will be described.

Figure 5F:
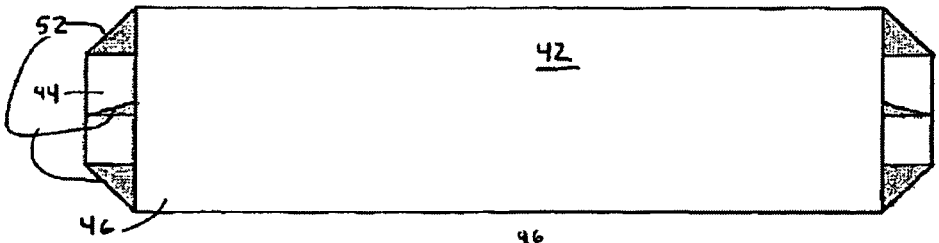
FIGS. 5A-5F illustrate the manufacturing steps of an embodiment of the gas directing mechanism.
Figure 5E:
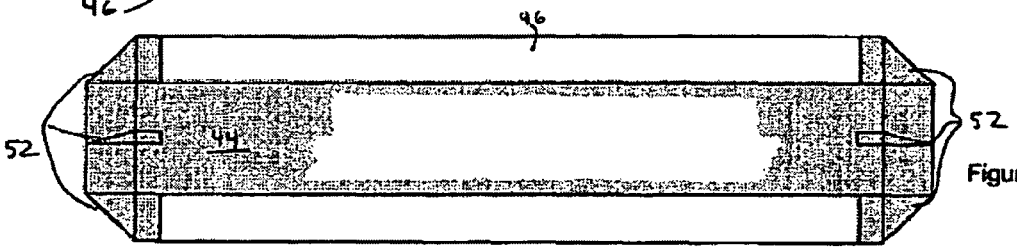
Figure 5D:
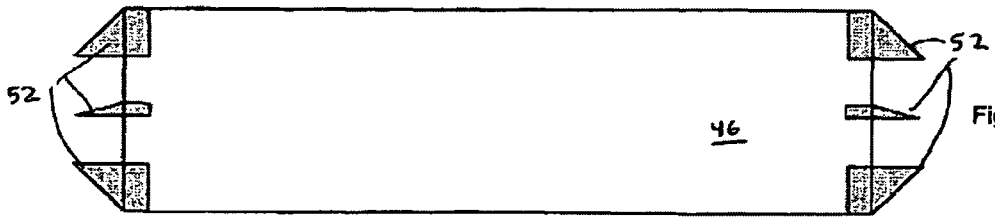
Figure 5C:
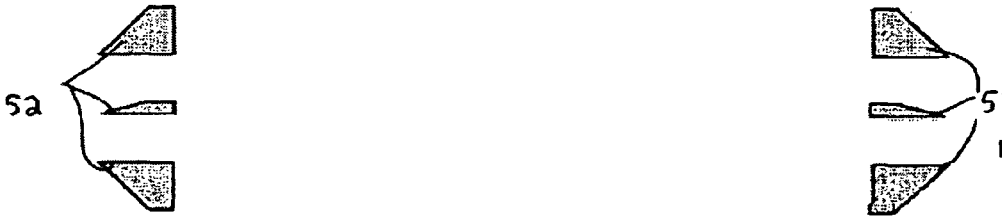
Figure 5B:
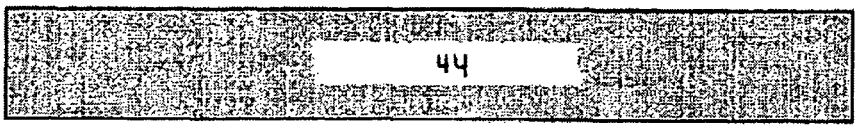
Figure 5A:
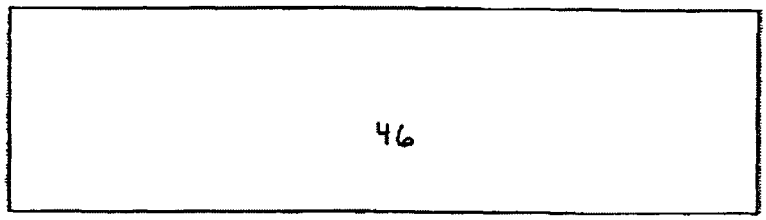

FIGS. 5A-5F illustrate the manufacturing steps of an alternative embodiment of the gas directing mechanism 42 in accordance with the invention in which the first pathway 44 extends beyond the second pathway 46 as shown in FIG. 5F. In particular, the first pathway 44 and the second pathway 46 are shown in FIGS. 5A and 5B as a first cylindrical tube 44 and a second cylindrical tube 46. The gas directing mechanism may further include one or more gas diffusing vanes 52 (six are shown in the embodiment shown in FIG. 5C, although the invention may have no vanes or a plurality of vanes) that direct the gas that enters and exits the gas directing mechanism 42. In more detail, the gas diffusing vanes 52 help center the first tube 44 (in the embodiment in which the first and second tubes are concentric) and provides a more uniformly straight airflow through the gas directing mechanism 42. As shown in FIG. 5D, the gas diffusing vanes 52 are attached to the inside of the second tube 46, such as by welding if an aluminum outer tube and aluminum air diffusing vanes are used, in the positions shown in FIG. 5D although the exact position and shape of the gas diffusing vanes 52 may be altered in accordance with the invention. Then, as shown in FIG. 5E, the first tube 44 is attached to the second tube 46 and the gas diffusing vanes 52, such as by welding in this example, wherein the first tube 44 extends out beyond the second tube slightly and to the ends of the gas diffusing vanes. In accordance with the invention, the exact positional relationship of the first and second tubes and the air diffusing vanes may be adjusted so that, for example, the first tube 44 does not extend beyond the second tube 46. FIGS. 5D and 5E are cut-away views in which the internal structure of the gas directing mechanism is shown whereas FIG. 5F is a side view of the gas directing mechanism 42 showing the first tube 44 and gas diffusing vanes 52 extending beyond the second tube 46. Now, more details of this embodiment of the gas directing mechanism will be described.

Figure 6A:
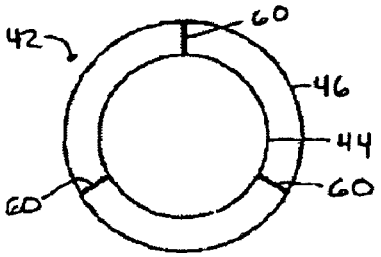
FIGS. 6A-6D illustrate more details of the gas directing mechanism.
Figure 6B:
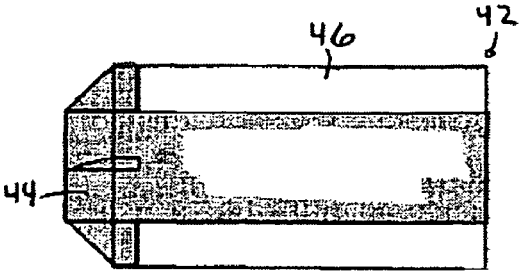
Figure 6C:
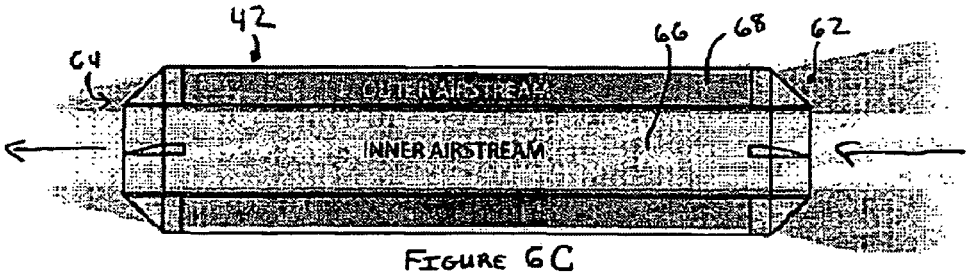
Figure 6D:
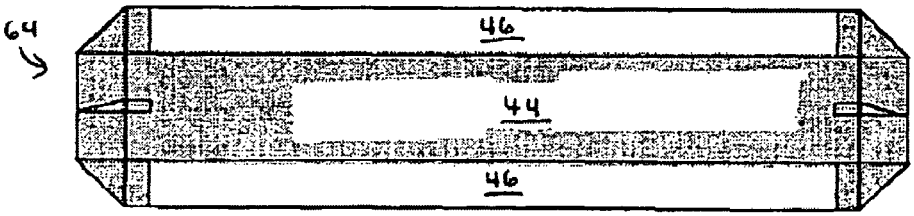

FIGS. 6A-6D illustrate more details of the gas directing mechanism 42 in accordance with the invention. FIG. 6A is an end view of the gas directing mechanism 42 with the first tube 44 and the second tube 46 concentrically positioned. The two tubes are connected to each other by one or more support members 60 as shown. FIG. 6B is a cut-away side view of the embodiment with the first tube 44 extending beyond the second tube 46 (by ½" in a preferred embodiment) wherein the extended first tube 44 helps direct the gases into the gas directing mechanism 42 and also direct the gases/air exiting the gas directing mechanism 42. FIGS. 6C and 6D illustrate the air flow benefits of the gas directing mechanism 42 in accordance with the invention. In particular, the gas entering the mechanism at an intake end 62 exits the mechanism at an exit end 64 with an increased velocity. As shown in FIG. 6C, the gas directing mechanism 42 separates the incoming gas into an inner gas-stream 66 and an outer gas-stream 68 which have different velocities. In particular, based on well known airflow principles, the gasflow in the first tube 44 (which has a smaller diameter) has a greater velocity (approximately double the velocity) than the gas flowing in the second tube 46. Then, when the gas-streams of the first and second tubes meet at the exit point 64, a vacuum is created at that point which doubles the airspeed of the total gas (air, in this example) that enters the internal combustion engine. The result of this gas directing mechanism is an increase in horsepower and torque as will be described below with reference to FIG. 9. Now, other embodiments of the gas directing mechanism in accordance with the invention will be described.

Figure 7A:
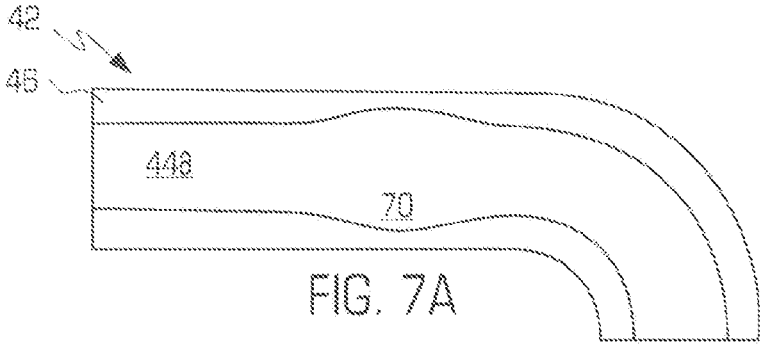
Figure 7B:
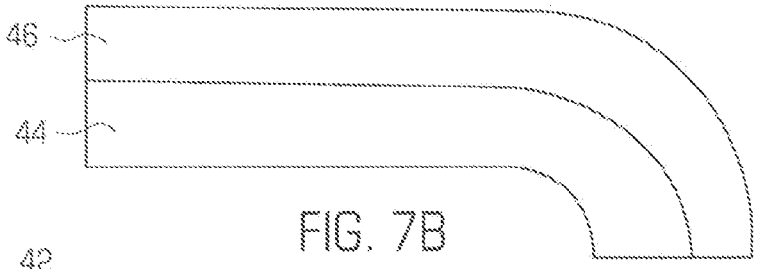
Figure 7C:
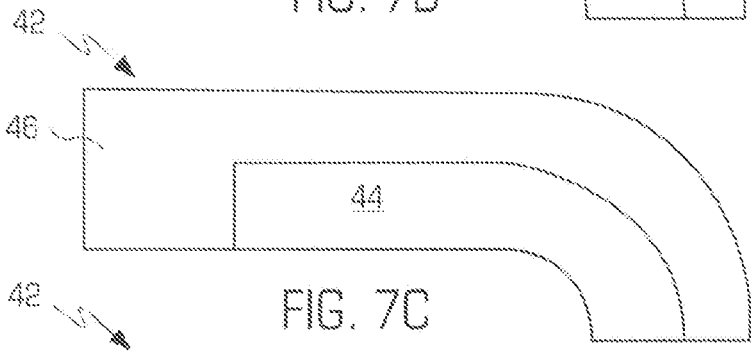
Figure 7D:
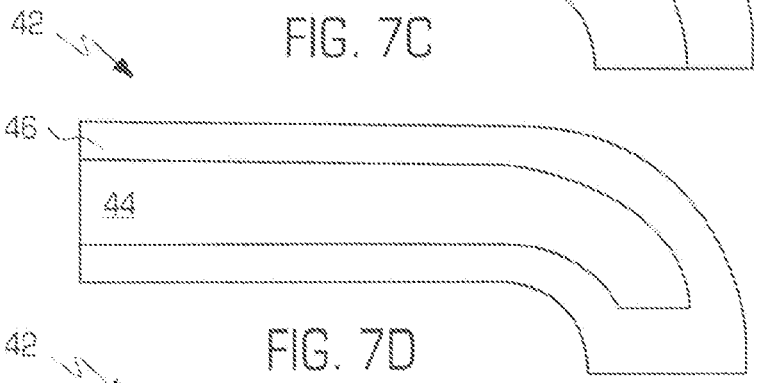
Figure 7E:
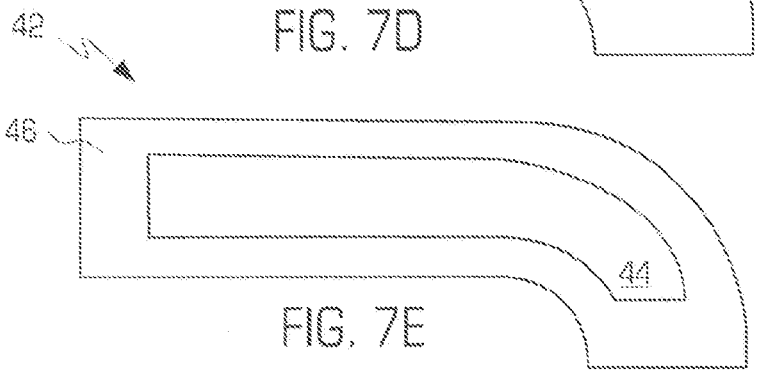

FIGS. 7A-7J illustrate other embodiments of the gas directing mechanism 42 in accordance with the invention which are different from the concentric first and second tube embodiment described above. FIG. 7A shows an gas directing mechanism 42 with a chambered first pathway 44*a* wherein the first pathway is not concentric with the second pathway 46 along the entire length of the second pathway. The precise position of an expanded region 70 may be moved in accordance with the invention. FIG. 7B illustrates an off-center design in which the first pathway 44 is located away from the center of the second pathway 46, such as along a wall as shown. The first pathway may also be located against the other wall of the second pathway. FIG. 7C illustrates another embodiment with a sectioned off-center design in which the first pathway 44 is off-center and shorter than the second pathway 46 so that one end of the first pathway is within the second pathway. FIG. 7D illustrates another embodiment with a centered, sectioned design in which the first pathway 44 is centered relative to the second pathway, but shorter than the second pathway 46 as shown (so that one end of the first pathway is located within the second pathway). FIG. 7E illustrates another embodiment, similar to that shown in FIG. 7D, wherein both ends of the first pathway 44 are inside of the second pathway 46.

Figure 7F:
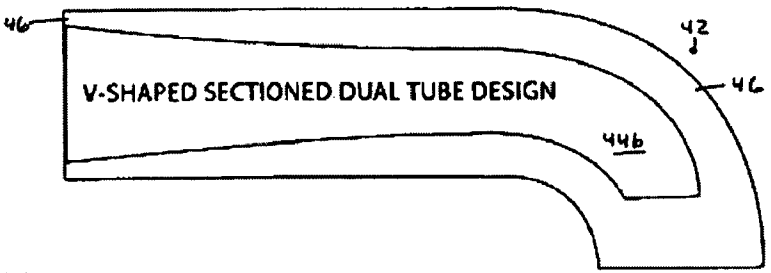
Figure 7G:
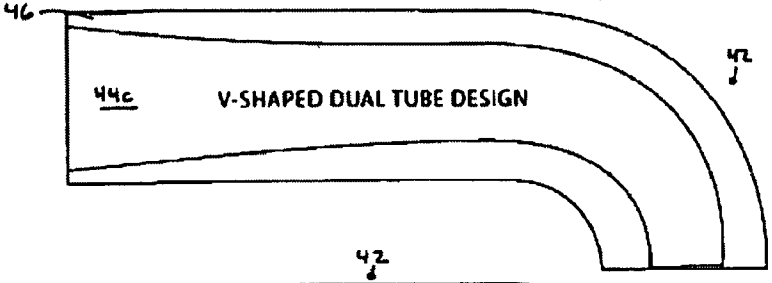
Figure 7H:
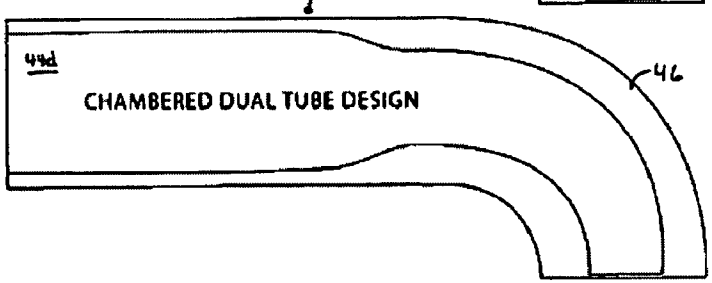
Figure 7I:
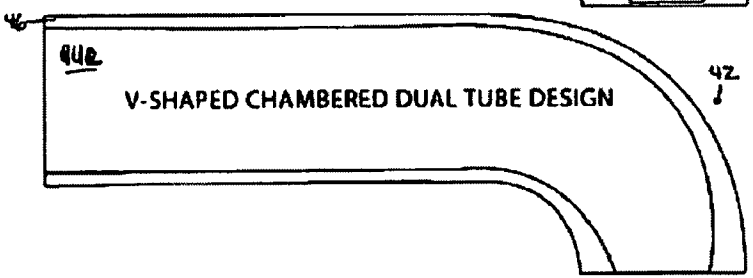

FIG. 7F illustrates another embodiment with a V-shaped sectioned dual pathway design in which a first pathway 44*b* has a cone shaped end (frustoconical end) and the other end is within the second pathway 46 as shown. FIG. 7G is another embodiment with a first pathway 44*c* that has a cone shaped end, but both ends are co-extensive with the ends of the second pathway 46. FIG. 7H is another embodiment which has a chambered design wherein a first pathway 44*d* fills most of the second pathway 46 at the input end and then is tapered at the output end. FIG. 7I is another embodiment of the gas directing mechanism which has a V-shaped chambered design in which a first pathway 44*e* has an input region and then slightly narrows at the output end. As shown in these figures, the particular shape, orientation and position of the first pathway/tube may be adjusted in many different manners and be within the scope of the invention. Similarly, the shape and size of the second pathway may also be adjusted and is within the scope of the invention. Now, other embodiments of the invention which utilize more than one first pathway will be described.

Figure 8A:
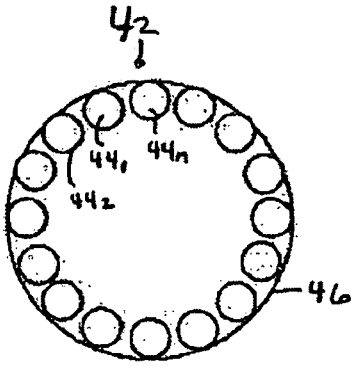
FIGS. 8A-8F illustrate several other embodiments of the gas directing mechanism in which there are more than one internal air pathway.
Figure 8B:
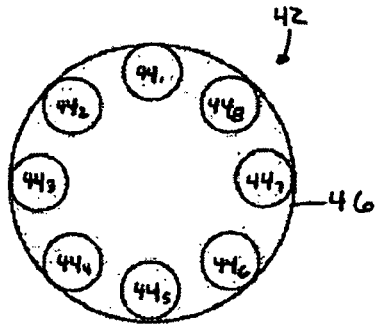
Figure 8C:
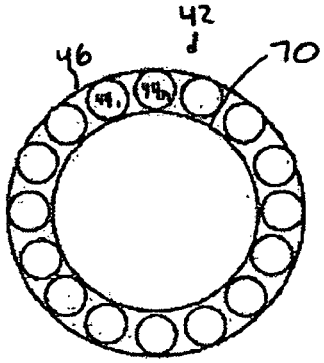
Figure 8D:
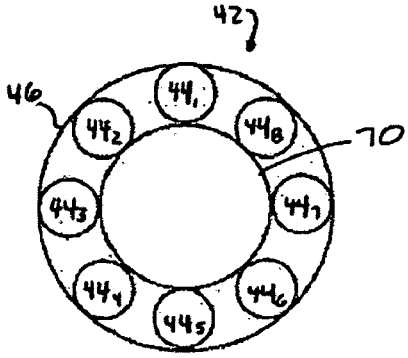
Figure 8E:
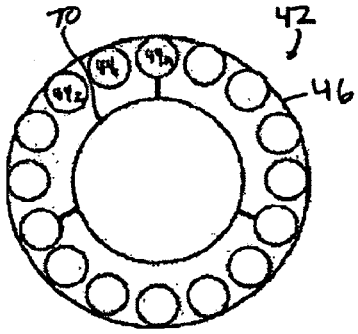
Figure 8F:
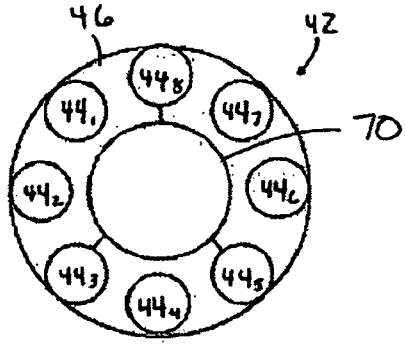

FIGS. 8A-8F illustrate several other embodiments of the gas directing mechanism 42 in accordance with the invention in which there are more than one internal air pathway. For example, FIGS. 8A and 8B illustrate two embodiments that comprise the second pathway 46 and one or more first pathways ($\mathbf{44}_1$-$\mathbf{44}_n$) inside of the second pathway wherein the multiple smaller first pathways increase the speed of the airflow and the airspeed of the gas exiting the gas directing mechanism. FIGS. 8C and 8D illustrate two other embodiments that comprise the second pathway 46, one or more first pathways ($\mathbf{44}_1$-$\mathbf{44}_n$) and a third pathway 70 as shown wherein the third pathway 70 is inside of the second pathway 46 and abuts the one or more first pathways as shown so that the first and third pathways are inside of the second pathway 46. In FIGS. 8C and 8D, there is no space between the third pathway 70 and the first pathways 44 as shown. FIGS. 8E and 8F show similar embodiments except that there is a gap between the third pathway 70 and the first pathways 44 as shown. In accordance with the invention, the invention is not limited to these embodiments and encompasses any gas directing mechanism with one or more first pathways 44 (and optionally a third pathway 70) within the second pathway 46.

Figure 9:
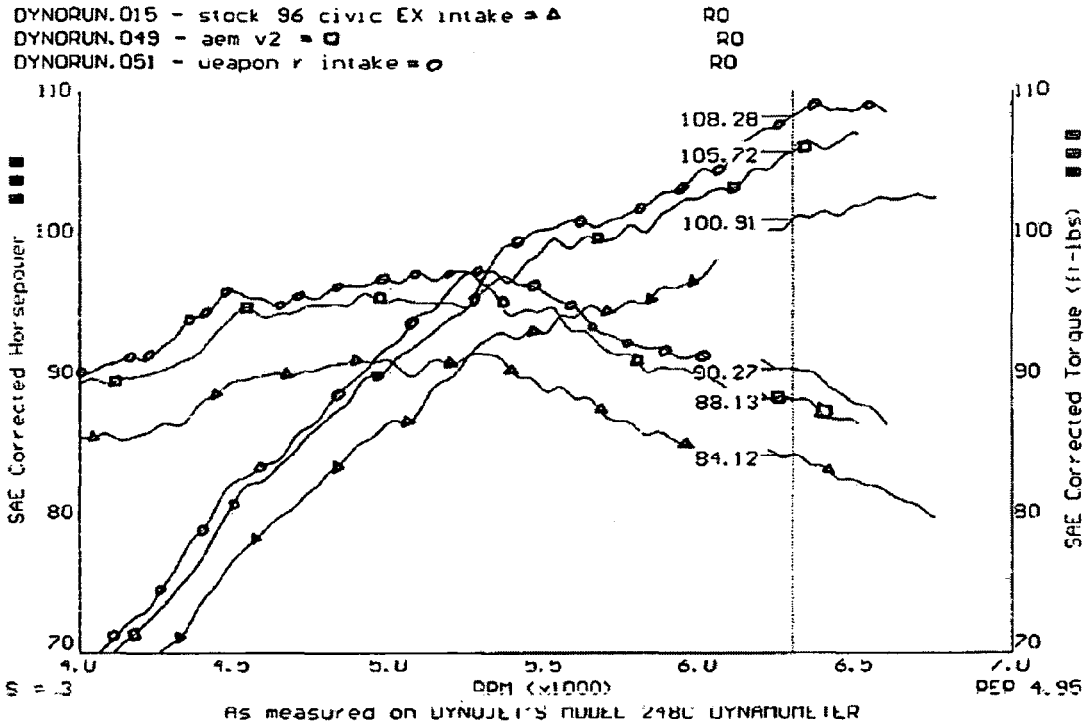
FIG. 9 illustrates a comparison of the performance gains for a typical gas directing system, for the AEM Power intake system and for the gas directing system.

FIG. 9 illustrates a comparison of the performance gains for a typical gas directing system, for the AEM Power intake system and for the gas directing system in accordance with the invention. The results shown in FIG. 9 were generated from a dynometer. During each run, a Honda Civic car was placed onto the dynometer and run at a particular speed to determine the maximum horsepower and torque of the engine as is well known. For example, as shown in FIG. 9, the horsepower and torque curves for a conventional air intake system (see curve with triangles along it in FIG. 9) are shown wherein the maximum horsepower is 102.7 and the maximum torque is 91.4. The horsepower and torque curve was then determined for the same car fitted with the AEM Power gas directing system (see curves with boxes along the line) described above. The car with the AEM Power system produced a maximum horsepower of 107.1 and a maximum torque of 96.1 which is an improvement over the typical car. The horsepower and torque curves for the same car fitted with the gas directing system in accordance with the invention was then measured. As shown in FIG. 9, the car with the gas directing system in accordance with the invention (see the curves with the circles along it in FIG. 8) had a maximum horsepower of 109.1 and a maximum torque of 97.2 which is a very significant improvement over the stock car air intake system and a significant improvement over the car fitted with the AEM Power gas directing system. In more detail, the gas directing system in accordance with the invention had a 2% horsepower increase and a 1% torque increase over the AEM Power air intake system.

Figure 10:
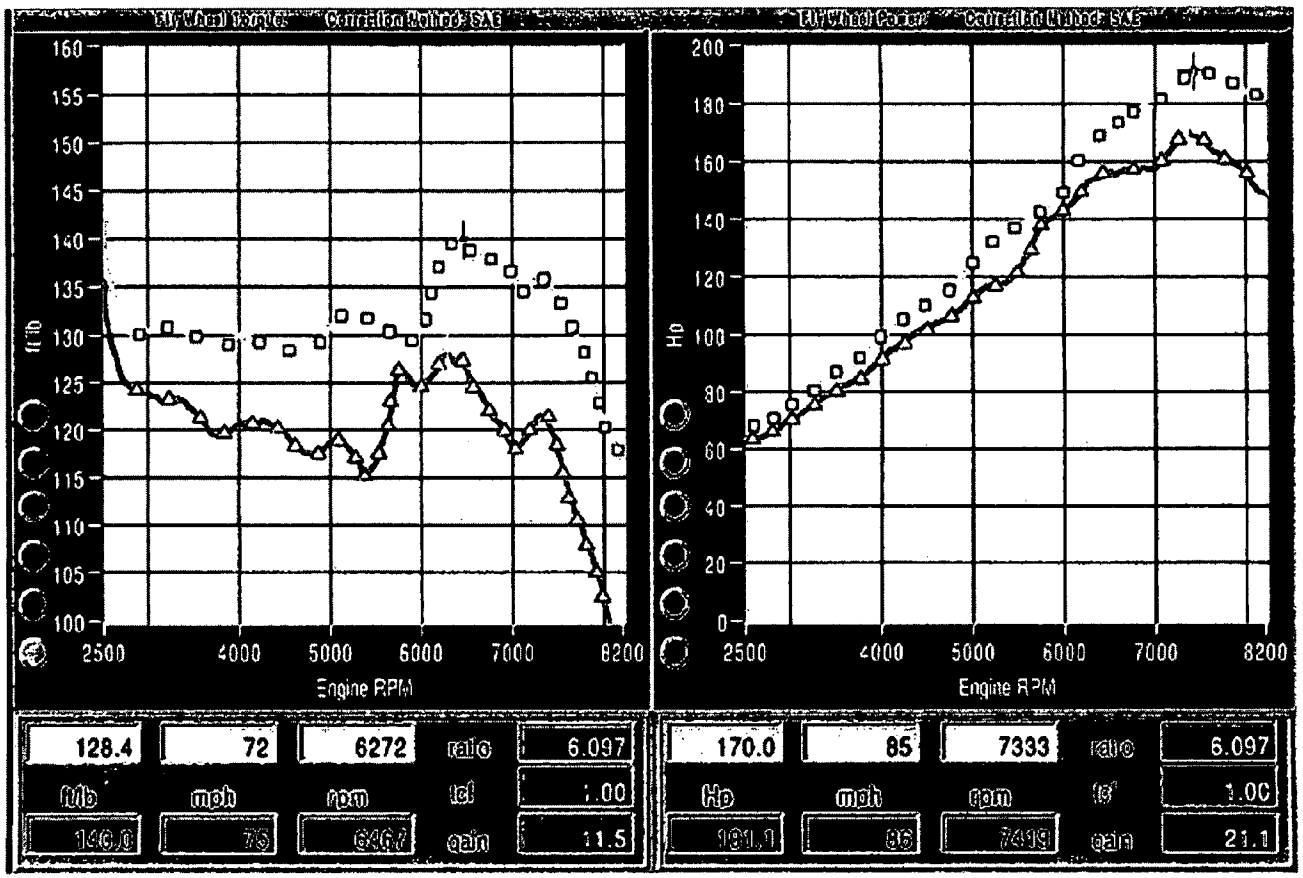
FIG. 10 illustrates a comparison of the horsepower and torque of an engine using a typical gas directing system with a single pipe having a 1.5" radius with the horsepower and torque of an engine using the inventive gas directing device having an outer piper with a 1.5" radius and an inner pipe with 1" radius.

FIG. 10 illustrates a comparison of the horsepower and torque of an engine using a typical gas directing system with a single pipe having a 1.5" radius with the horsepower and torque of an engine using the inventive gas directing device having an outer piper with a 1.5"radius and an inner pipe with 1" radius in which both of the gas directing devices are connected to the same vehicle (an Acura Integra) to provide air intake into the engine. The engine of the vehicle was operated at the same temperature and under the same conditions for both the typical gas directing system and the inventive gas directing system. In the charts of FIG. 10, the revolutions of the engine of the Acura Integra was then increased (when attached to each gas directing device) and the results captured on a dynometer that shows the torque and horsepower of the engine at different RPMs as shown in FIG. 10. The torque (left side chart) and the horsepower (right side chart) values for the typical gas directing system with the single pipe has values that are shown as a line with triangles periodically along the line. The torque (left side chart) and the horsepower (right side chart) values for the inventive gas directing device has values that are shown as a line with squares periodically along the line. As shown in FIG. 10, the inventive gas directing device results in a higher peak horsepower (191.1 vs. 170.0) than the typical single pipe gas directing system. In fact, the horsepower generated by the engine attached to the inventive gas directing system at various different RPMs is always higher than the engine attached to the typical gas directing system.

FIGS. 11A-11H illustrates an enhanced gas directing mechanism that has the first pathway 44 that may be centered relative to the second pathway 46. In first and second pathways 44, 46 operate in a similar manner to the first and second pathways 44, 46 as described above. In this mechanism, the first pathway 44 has an angled end 80 (at the inlet) that allows more gas/air to be directed into the first pathway 44 in part due to the fact that the angled end 80 also has a larger cross-sectional area than non-angled end. The angled end may have an angle from 35 degrees to 85 degrees (almost straight cut) from the ground. The first pathway 44 with the angled end 80 also permits the gas directing mechanism to be inserted/retrofitted into an exiting air intake system of a internal combustion engine. Thus, the advantage of the gas directing mechanism (increased horsepower as described above) can be achieved by retrofitting the gas directing mechanism shown in FIGS. 11A-11H into an exiting air intake system of an internal combustion engine. In addition, the gas directing mechanism may be installed inside of the original air intake of an internal combustion engine and provide the same benefits when it replaces the original air intake.

The gas directing mechanism shown in FIGS. 11A-11H may also include an adjustment mechanism 82 that allows the diameter of the second pathway 46 to be adjusted to fit the diameter of the particular internal combustion engine onto which the gas directing mechanism is attached. The adjustment mechanism 82 may be, for example, a buckle that is loosened so that the diameter of the second pathway 46 is adjusted and then the buckle is tightened. The buckle operates by one end of the pathway sliding into the other end of the pathway until the desired diameter is reached and then stays at that diameter due to friction. The adjustment mechanism may also be any other mechanism known in the art that would the second pathway 46 diameter to be adjusted and then allow the adjustment mechanism to be tightened.

As with the other gas directing mechanisms, the gas directing mechanism may include one or more attachment devices 55 that connect the first and second pathways 44, 46 to each other. The attachment devices may be a wall that can connect the first and second pathways 44, 46 once it is secured, but may also be a piece of material or vane. In the gas directing mechanism shown in FIGS. 11A-11H, a first attachment device 55*a* is rigidly connected to the first and second pathways 44, 46 while a second and third attachment device 55*b*, 55*c* may be rigidly connected only to the first pathway 44. Thus, when the diameter of the second pathway 46 is adjusted, the second and third attachment devices 55*b*, 55*c* slide around the interior of the second pathway 46. As shown in FIGS. 7F-7I, an inlet end of the first pathway 44 of the gas directing mechanism shown in FIGS. 11A-11H may be narrower than the outlet end of the first pathway 44.

While the foregoing has been with reference to a particular embodiment of the invention, it will be appreciated by those skilled in the art that changes in this embodiment may be made without departing from the principles and spirit of the invention, the scope of which is defined by the appended claims.

The invention claimed is:

1. A gas directing mechanism, comprising:

a first pathway having an inlet and an outlet;

a second pathway having an adjustment mechanism so that the diameter of the second pathway is adjustable;

the first pathway being inside of the second pathway and extending beyond the second pathway so that gas flows simultaneously through the first and second pathways wherein the inlet of the first pathway is angled to allow more air to flow through the first pathway when the gas directing mechanism is connected to an internal combustion engine; and the gas passing through the first pathway having a first velocity and the gas passing through the second pathway having a second velocity wherein the first velocity gas and second velocity gas combine to form an output gas and a vacuum at the point at which the first and second velocity gases combine to increase the horsepower of an internal combustion engine connected to the gas air directing mechanism.

2. The mechanism of claim 1, wherein the first and second pathways each comprise a cylindrical tube.

3. The mechanism of claim 2, wherein the first and second pathways are concentric.

4. The mechanism of claim 1 further comprising one or more brackets attached to the second pathway and first pathway that center the first pathway inside of the second pathway.

5. The mechanism is claim 1 wherein the angled inlet has an angle in the range between 35 degrees and 85 degrees.

6. The mechanism of claim 1, wherein the adjustment mechanism further comprises a buckle.

7. The mechanism of claim 1 further comprising a first attachment device and a second attachment device at spaced apart locations on the first pathway, the first attachment device connected to the first and second pathways and the second attachment device being connected only to the first pathway and being slidable relative to the second pathway to accommodate the adjustable diameter of the second pathway.

8. The mechanism of claim 7 further comprising a third attachment device spaced apart from the first and second attachment devices and being connected only to the first pathway and being slidable relative to the second pathway to accommodate the adjustable diameter of the second pathway.

9. A method for installing a gas directing mechanism onto an internal combustion engine, comprising:

providing a gas directing mechanism having a first pathway having an inlet and an outlet, a second pathway and first attachment device and a second attachment device at spaced apart locations on the first pathway, the first attachment device connected to the first and second pathways and the second attachment device being connected only to the first pathway and being slidable relative to the second pathway to accommodate the adjustable diameter of the second pathway, the first pathway being inside of the second pathway and extending beyond the second pathway so that gas flows simultaneously through the first and second pathways wherein the second pathway further comprises an adjustment mechanism so that the diameter of the second pathway is adjustable;

adjusting the diameter of the second pathway to fit an air intake of an internal combustion engine using the adjustment mechanism; and installing the gas directing mechanism onto the internal combustion engine wherein the gas passing through the first pathway has a first velocity and the gas passing through the second pathway has a second velocity wherein the first velocity gas and second velocity gas combine to form an output gas and a vacuum at the point at which the first and second velocity gases combine to increase the horsepower of the internal combustion engine connected to the gas directing mechanism.

10. The method of claim 9, wherein the gas directing mechanism fits within an air intake mechanism of the internal combustion engine.

* * * * *